United States Patent [19]

Kroll et al.

[11] Patent Number: 4,531,832

[45] Date of Patent: Jul. 30, 1985

[54] ELECTROGRAPHIC APPARATUS, METHOD AND SYSTEM EMPLOYING IMAGE DEVELOPMENT ADJUSTMENT

[75] Inventors: Arthur S. Kroll; Frank A. Shuster, both of Rochester, N.Y.

[73] Assignee: Eastman Kodak Company, Rochester, N.Y.

[21] Appl. No.: 519,476

[22] Filed: Aug. 1, 1983

[51] Int. Cl.[3] ..... G03G 15/09

[52] U.S. Cl. ..... 355/3 DD; 118/657

[58] Field of Search ..... 355/3 DD, 14 D; 118/657, 658, 698; 430/122

[56] References Cited

U.S. PATENT DOCUMENTS

| | | | |
|---|---|---|---|
| 3,152,924 | 10/1964 | Wanielista et al. | 118/637 |
| 4,235,194 | 11/1980 | Wada et al. | 118/657 |
| 4,267,248 | 5/1981 | Yamashita et al. | 118/657 X |
| 4,288,515 | 9/1981 | Yamashita et al. | 118/658 X |
| 4,334,497 | 6/1982 | Oka et al. | 118/698 |
| 4,345,014 | 8/1982 | Oka et al. | 430/122 |
| 4,435,065 | 3/1984 | Wada | 118/658 X |
| 4,435,494 | 3/1984 | Goto et al. | 118/657 X |
| 4,457,257 | 7/1984 | Murakami et al. | 118/657 X |

FOREIGN PATENT DOCUMENTS 2029279A 5/1980 United Kingdom .

OTHER PUBLICATIONS

"Plain-Paper Copies Get Sharper Image With New Developer 'Pana Fine Process'"; reprint of article from the *National Technical Report,* vol. 28, No. 4, Aug. 1982.

*Primary Examiner*—R. L. Moses

*Attorney, Agent, or Firm*—John D. Husser

[57] ABSTRACT

Contrast and/or density adjustment of developed electrographic images is effected in a development system comprising a hard magnetic carrier and a magnetic brush having a rotary core and shell. The adjustment is effected by cooperatively varying the core and shell rotation rates, within predetermined ranges, in a manner which maintains the operative developer linear velocity generally equal to, and co-current with, the velocity of an electrographic image member's movement through the development zone.

9 Claims, 4 Drawing Figures

ELECTROGRAPHIC APPARATUS, METHOD AND SYSTEM EMPLOYING IMAGE DEVELOPMENT ADJUSTMENT

BACKGROUND OF THE INVENTION

1. Field of the Invention

The present invention relates to electrographic apparatus, methods and systems that employ a small particle developer mixture of hard magnetic carrier and electrically insulative toner and more specifically to techniques and structures for adjusting the development (e.g. the density and/or contrast) of electrographic images.

2. Description of the Prior Art

U.S. application Ser. No. 510,109, entitled "Improved Electrographic Development Method, Apparatus and System, and filed July 1, 1983, in the name of Fritz et al, discloses a system wherein improved electrographic development is obtained, in the presence of a development electrode field, by predeterminedly rotating the core and shell of a magnetic brush applicator that supplies a small particle developer mixture (comprising hard-magnetic carrier and electrically insulative toner) to a moving electrostatic image member. In one preferred embodiment the core and shell are cooperatively rotated so that toner plated-out on the shell does not adversely affect image development and so that the developer has a generally equal and co-current linear velocity to the image member.

In the development method and apparatus disclosed in that application, the amounts of toner transferred to the developed electrostatic image portions can be adjusted in the conventional manner, viz. by controlling the electrical bias of the development electrode. The density and contrast characteristics of the developed electrostatic image also can be varied by adjusting other parameters of the electrophotographic system. For example, U.S. Pat. No. 4,350,435 discloses apparatus for cooperatively controlling the primary charge level, the image exposure level and/or the magnetic brush bias level to control the contrast and density of copies, i.e. for adjusting the input original density ($D_{in}$) to output copy density ($D_{out}$) characteristic (gamma curve) of the electrophotographic system.

Although the traditional development electrode and the contrast/density control of the types disclosed in U.S. Pat. No. 4,350,435 are highly useful in apparatus employing development systems such as disclosed in the Fritz et al application, it is desirable to have additional flexibility in adjusting the $D_{in}/D_{out}$ characteristics of electrophotographic systems. I have found that the development system disclosed in the Fritz et al application is susceptible to a unique development control approach which provides such additional image development adjustment flexibility.

SUMMARY OF THE INVENTION

Thus, one important purpose of the present invention is to provide improved means and methods for adjusting the development of electrographic images, e.g., in systems of the kind disclosed in the Fritz et al application.

More particularly, the present invention provides such improvments for electrographic apparatus wherein an imaging member is moved through a development zone whereat developer (comprising a mixture of electrically insulative toner particles and hardmagnetic carrier particles) is applied by a magnetic brush that includes: (1) a non-magnetic cylindrical shell which is rotatable for transporting developer between a supply and the development zone; (2) a magnetic core that includes a plurality of magnetic pole portions located around its periphery in alternating magnetic polarity relation and is rotatable within the shell; and (3) drive means for predeterminedly rotating the shell and the core so that the developer moves through the development zone co-currently with the image member and with an operative linear velocity generally equal to the linear velocity of the image member. The improvement of the present invention comprises, in one aspect, development adjustment means for predeterminedly varying the rotational rate of such shell and core, cooperatively, to adjust developed image density and/or contrast, while maintaining the operative developer velocity and direction conditions.

BRIEF DESCRIPTION OF THE DRAWINGS

The subsequent detailed description of preferred embodiments of the invention refers to the attached drawings wherein.

DETAILED DESCRIPTION OF THE PREFERRED EMBODIMENTS

Figure 1:
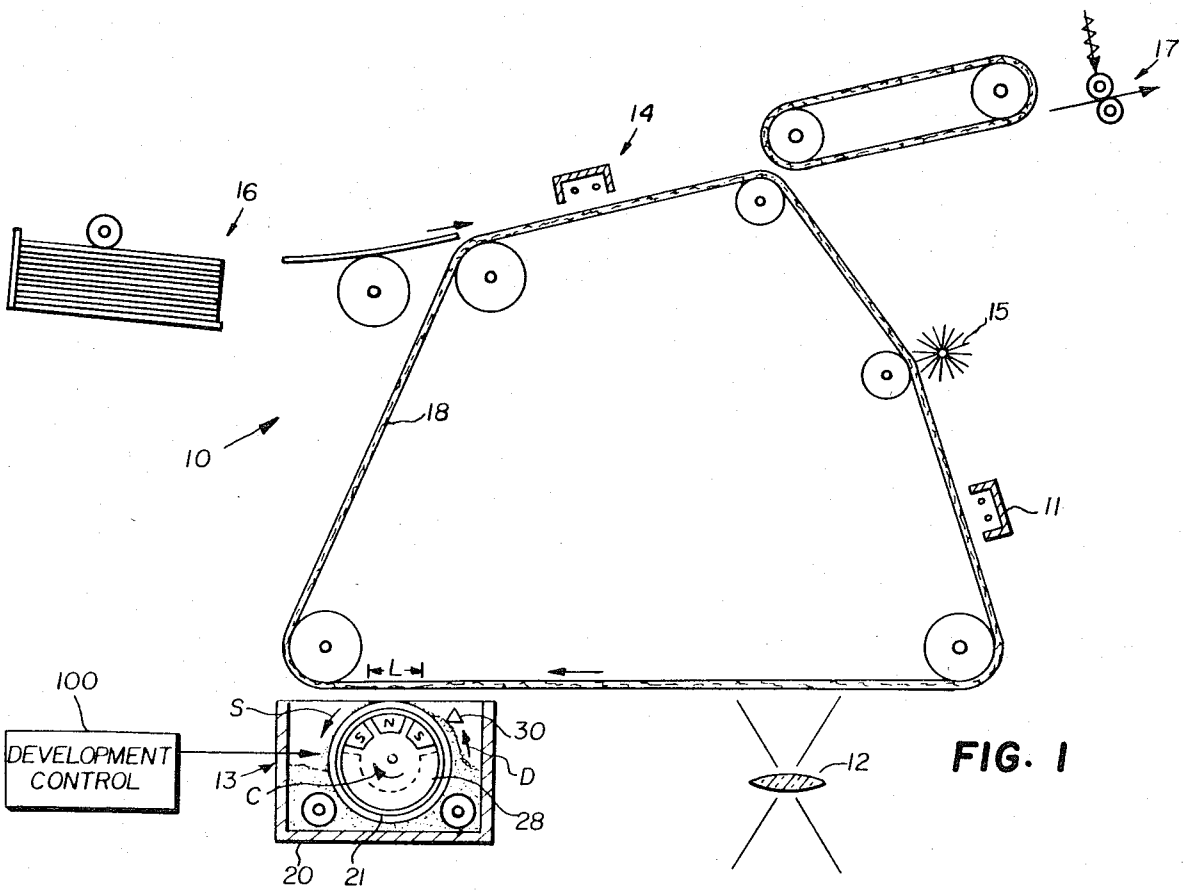
FIG. 1 is a schematic illustration of one electrographic apparatus for practice of the present invention.

FIG. 1 illustrates one exemplary electrographic apparatus 10 for practice of the present invention. In this embodiment, apparatus 10 comprises an endless electrophotographic image member 18 which is movable around an operative path past a primary charging station (represented by corona discharge device 11), an exposure station 12, a development station 13, a transfer station 14 and a cleaning station 15. In operation, device 11 applies a uniform electrostatic charge to a sector of the image member 18, which is then exposed to a light image at station 12 (to form a latent electrostatic image) and next developed with toner at station 13. The toner image is subsequently transferred to a copy sheet (fed from sheet supply 16) by transfer charger at station 14, and the toner-bearing copy sheet is fed through fusing rollers 17 to fix the transferred toner image. The image member sector is next cleaned at station 15 and is ready for reuse. With exception of the development station, the various stations and devices shown in FIG. 1 are conventional and can take various other forms.

Figure 2:
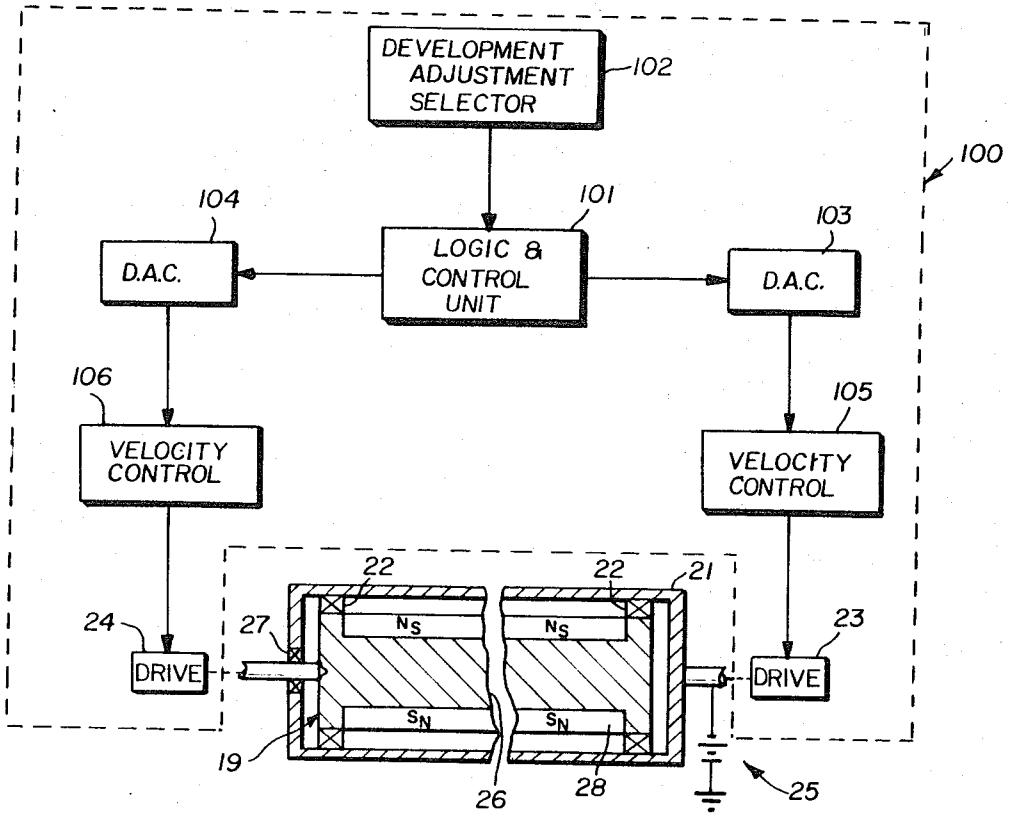
FIG. 2 is a cross-sectional view of a portion of the FIG. 1 development station.

Referring now to both FIGS. 1 and 2, a supply of developer D is contained within a housing 20, having developer mixing means located in a developer sump. A non-magnetic shell portion 21, (e.g. formed of stainless steel, aluminum, conductively coated plastic or fiberglass or carbon-filled plexiglass) is located in the housing 20 and mounted for rotation on a central axis by bearings 22. Drive means 23 is adapted to rotate the shell counterclockwise as shown in FIG. 1 and the shell is coupled to a source of reference potential 25. Within the shell 21 a magnetic core means 19 is mounted for rotation on bearings 22 and 27 and drive means 24 is adapted to rotate the core in a clockwise direction as viewed in FIG. 1. The core means 19 can have various forms known in the art but the illustrated embodiment comprises a ferrous core 26 having a plurality of permanent magnet strips 28 located around its periphery in alternating polarity relation (See FIG. 1). The magnetic strips of the applicator can be made up of any one or more of a variety of well-known permanent magnet materials. Representative magnetic materials include gamma ferric oxide, and "hard" ferrites as disclosed in U.S. Pat. No. 4,042,518 issued Aug. 16, 1977, to L. O. Jones. The strength of the core magnetic field can vary widely, but a strength of at least 450 gauss, as measured at the core surface with a Hall-effect probe, is preferred and a strength of from about 800 to 1600 gauss is most preferred. In some applications electromagnets might be useful. Preferred magnet materials for the core are iron or magnetic steel.

In general, the core size will be determined by the size of the magnets used, and the magnet size is selected in accordance with the desired magnetic field strength. As described in more detail in the Fritz et al application a useful number of magnetic poles for a 2" core diameter is from 8 to 24 with a preferred number from 12 to 20; however this parameter will depend on the core size and rotation rate. Preferably the shell-to-photoconductor spacing is relatively close, e.g., in the range from about 0.01 inches to about 0.03 inches. A skive 30 is located to trim the developer fed to the development zone and desirably has about the same spacing from the shell as the photoconductor-to-shell spacing. After considering the subsequent description of useful and preferred shell, core and developer velocities, one skilled in the art will appreciate that there are various other alternative development station configurations that can function in accord with the general principles of the present invention.

However, first the characteristics of the dry developer compositions which are particularly useful in accord with the present invention will be described. Exemplary developers are described in more detail in U.S. application Ser. No. 440,146, filed Nov. 8, 1982 in the names of Miskinis and Jadwin, which is incorporated by reference for that teaching. In general such developer comprises charged toner particles and oppositely charged carrier particles that contain a magnetic material which exhibits a predetermined, high-minimum-level of coercivity when magnetically saturated. More particularly such high-minimum-level of saturated coercivity is at least 100 gauss (when measured as described below) and the carrier particles can be binderless carriers (i.e., carrier particles that contain no binder or matrix material) or composite carriers (i.e. carrier particles that contain a plurality of magnetic material particles dispersed in a binder). Binderless and composite carrier particles containing magnetic materials complying with the 100 gauss minimum saturated coercivity levels are referred to herein as "hard" magnetic carrier particles.

In composite carrier particles utilized in accord with the present invention, the individual bits of the magnetic material are preferably of a relatively uniform size and smaller in diameter than the overall composite carrier particle size. The average diameter of the magnetic material desirably are no more than about 20 percent of the average diameter of the carrier particle. Preferably, a much lower ratio of average diameter of magnetic component to carrier can be used. Excellent results are obtained with magnetic powders of the order of 5 microns down to 0.05 micron average diameter. Even finer powders can be used when the degree of subdivision does not produce unwanted modifications in the magnetic properties and the amount and character of the selected binder produce satisfactory strength, together with other desirable mechanical properties in the resulting carrier particle. The concentration of the magnetic material can vary widely. Proportions of finely divided magnetic material, from about 20 percent by weight to about 90 percent by weight, of the composite carrier particle can be used.

The matrix material used with the finely divided magnetic material is selected to provide the required mechanical and electrical properties. It desirably (1) adheres well to the magnetic material, (2) facilitates formation of strong, smooth-surfaced particles and (3) possesses sufficient difference in triboelectric properties from the toner particles with which it will be used to insure the proper polarity and magnitude of electrostatic charge between the toner and carrier when the two are mixed.

The matrix can be organic, or inorganic such as a matrix composed of glass, metal, silicon resin or the like. Preferably, an organic material is used such as a natural or synthetic polymeric resin or a mixture of such resins having appropriate mechanical and triboelectric properties. Appropriate monomers (which can be used to prepare resins for this use) include, for example, vinyl monomers such as alkyl acrylates and methacrylates, styrene and substituted styrenes, basic monomers such as vinyl pyridines, etc. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of such composite carrier particles may involve the application of heat to soften thermoplastic material or to harden thermosetting material; evaporative drying to remove liquid vehicle; the use of pressure, or of heat and pressure, in molding, casting, extruding, etc., and in cutting or shearing to shape the carrier particles; grinding, e.g., in a ball mill to reduce carrier material to appropriate particle size; and sifting operations to classify the particles.

According to one preparation technique, the powdered magnetic material is dispersed in a dope or solution of the binder resin. The solvent may then be evaporated and the resulting solid mass subdivided by grinding and screening to produce carrier particles of appropriate size.

According to another technique, emulsion or suspension polymerization is used to produce uniform carrier particles of excellent smoothness and useful life.

As used herein with respect to a magnetic material (such as in binderless or composite carrier particles) the term coercivity and saturated coercivity refer to the external magnetic field (measured in gauss as described below) that is necessary to reduce the material's remanance (Br) to zero while it is held stationary in the external field and after the material has been magnetically saturated (i.e., after the material has been permanently magnetized). Specifically, to measure the coercivity of the carrier particles' magnetic material, a sample of the material (immobilized in a polymer matrix) can be placed in the sample holder of a Princeton Applied Research Model 155 Vibrating Sample Magnetometer, available from Princeton Applied Research Co., Princeton, N.J., and a magnetic hysteresis loop of external field (in gauss units) versus induced magnetism (in EMU/gm) plotted.

Figure 3:
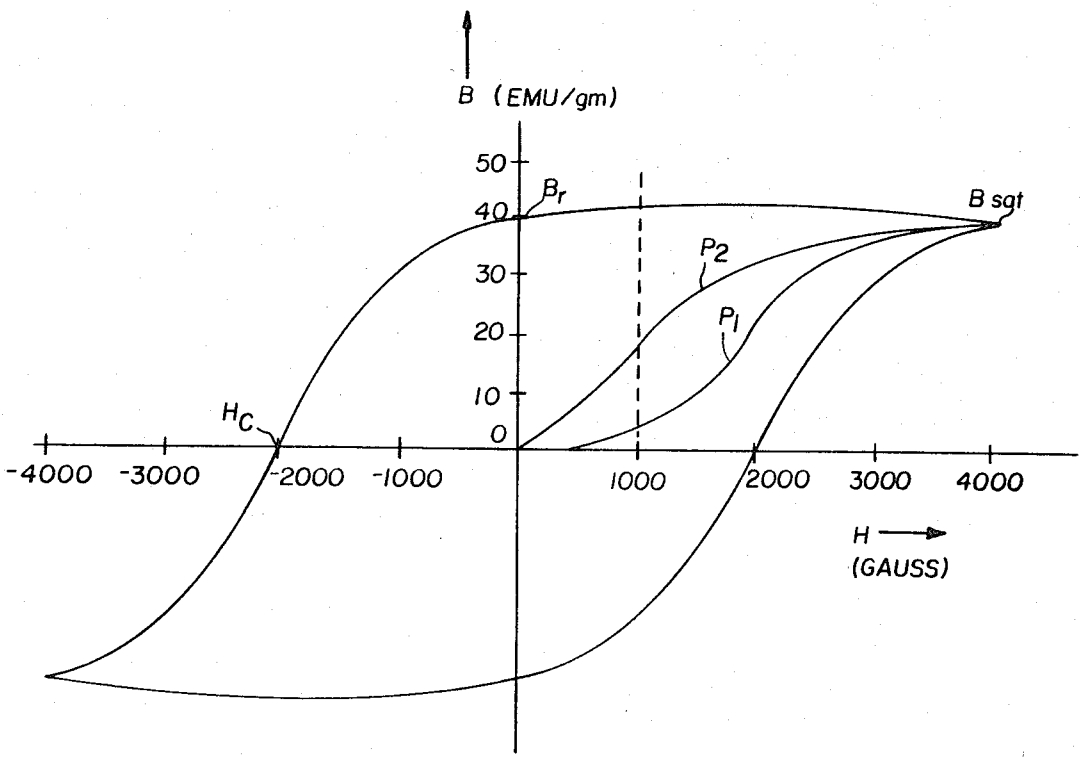
FIG. 3 is a diagram indicating magnetic characteristic of carrier useful in accord with the present invention.

FIG. 3 represents a hysteresis loop L for a typical "hard" magnetic carrier when magnetically saturated. When the carrier material is magnetically saturated and immobilized in an applied magnetic field H of progressively increasing strength, a maximum, or saturated magnetic moment, Bsat, will be induced in the material. If the applied field H is further increased, the moment induced in the material will not increase any further. When the applied field is progressively decreased through zero, reversed in applied polarity and progressively increased in the reverse polarity, the induced moment B of the carrier material will ultimately become zero and thus be on the threshold of reversal in induced polarity. The value of the applied field H (measured in gauss in an air gap such as in the above-described magnetometer apparatus) that is necessary to bring about the decrease of the remanance, Br, to zero is called the coercivity, Hc, of the material. The carriers of developers useful in the present invention, whether composite or binder-free carriers, preferably exhibit a coercivity of at least 500 gauss when magnetically saturated, most preferably a coercivity of at least 1000 gauss.

It is also important that there be sufficient magnetic attraction between the applicator and the carrier particles to hold the latter on the applicator shell during core rotation and thereby reduce carrier transfer to the image. Accordingly, the magnetic moment, B, induced in the carrier magnetic material by the field, H, of the rotating core, desirably is at least 5 EMU/gm, preferably at least 10 EMU/gm, and most preferably at least 25 EMU/gm, for applied fields of 1000 gauss or more. In this regard, carrier particles with induced fields at 1000 gauss of from 40 to 100 EMU/gm have been found to be particularly useful.

FIG. 3 shows the induced moment, B, for two different materials whose hysterisis loop is the same for purposes of illustration. These materials respond differently to magnetic fields as represented by their permeability curves, $P_1$ and $P_2$. For an applied field of 1000 gauss as shown, material $P_1$ will have a magnetic moment of about 5 EMU/gm, while material $P_2$ will have a moment of about 15 EMU/gm. To increase the moment of either material, one skilled in the art can select from at least two techniques: he can either increase the applied field of the core above 1000 gauss or subject the material off-line to a field higher than the core field and thereafter reintroduce the material into the field of the core. In such off-line treatment, the material is preferably magnetically saturated, in which case either of the materials shown in FIG. 3 will exhibit an induced moment, B, of about 40 EMU/gm.

It will be appreciated by those skilled in the art that the carrier particles in the two-component developer useful with the present invention need not be magnetized in their unused, or fresh, state. In this way, the developer can be formulated and handled off-line without unwanted particle-to-particle magnetic attraction. In such instances, aside from the necessary coercivity requirements, it is simply important that, when the developer is exposed to either the field of the rotatable core or some other source, the carrier attain sufficient induced moment, B, to cling to the shell of the applicator. In one embodiment, the permeability of the unused carrier magnetic material is sufficiently high so that, when the developer contacts the applicator, the resulting induced moment is sufficient to hold the carrier to the shell without the need for off-line treatment as noted above.

Useful "hard" magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides having the general formula $MFeO_2$ or $MFe_2O_4$ where M represents a mono- or divalent metal and the iron is in the oxidation state of +3 are ferrites.

Preferred ferrites are those containing barium and/or strontium, such as $BaFe_{12}O_{19}$, $SrFe_{12}O_{19}$ and the magnetic ferrites having the formula $MO{\cdot}6Fe_2O_3$, where M is barium, strontium or lead, as disclosed in U.S. Pat. No. 3,716,630 issued Feb. 13, 1973, to B. T. Shirt, the disclosure of which is incorporated herewith by reference.

The size of the "hard" magnetic carrier particles useful in the present invention can vary widely, but desirably the average particle size is less than 100 microns. A preferred average carrier particle size is in the range from about 5 to 45 microns. From the viewpoint of minimizing carrier pick-up by the developed image, it has been found preferable to magnetically saturate such small carrier particles so that, in a core field of 1000 gauss, for example, a moment of at least 10 EMU/gm is induced, and a moment of at least 25 EMU/gm is preferably induced.

In accord with the present invention, carrier particles are employed in combination with electrically insulative toner particles to form a dry, two-component composition. In use the toner and developer should exhibit opposite electrostatic charge, with the toner having a polarity opposite the electrostatic image to be developed.

Desirably tribocharging of toner and "hard" magnetic carrier is achieved by selecting materials that are positioned in the triboelectric series to give the desired polarity and magnitude of charge when the toner and carrier particles intermix. If the carrier particles do not charge as desired with the toner employed, the carrier can be coated with a material which does.

The carrier/toner developer mixtures of the present invention can have various toner concentrations, and desirably high concentrations of toner can be employed. For example, the developer can contain from about 70 to 99 weight percent carrier and about 30 to 1 weight percent toner based on the total weight of the developer; preferably, such concentration is from about 75 to 92 weight percent carrier and from about 25 to 8 weight percent toner.

The toner component can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in *Colour Index*, Vols. I and II, 2nd Edition. Carbon black is especially useful. The amount of colorant can vary over a wide range, e.g., from 3 to 20 weight percent of the polymer.

The mixture is heated and milled to disperse the colorant and other addenda in the resin. The mass is cooled, crushed into lumps and finely ground. The resulting toner particles range in diameter from 0.5 to 25 microns with an average size of 1 to 16 microns. In this regard, it is particularly useful to formulate the developers for the present invention with toner particles and carrier particles which are relatively close in average diameter. For example, it is desirable that the average particle size ratio of carrier to toner lie within the range from about 4:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadamatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sept. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in *Research Disclosure,* No. 21030, Volume 210, October, 1981 (published by Industrial Opportunities Ltd., Homewell, Havant, Hampshire, P09 1EF, United Kingdom), are also useful.

With respect to core and shell rotations for practice of the present invention, the aboveidentified application of Fritz et al describes the physical mechanisms pertaining to, and the useful and preferred parameters for, the shell and core rotations and for developer transport. That application is incorporated herein by reference for those teachings. By way of general summary, it is desirable that the shell rotate at a rate that which prevents toner that is plated thereon from adversely affecting image development. A desirable shell surface linear velocity $Vel._s$ (in inches/sec) for this purpose is greater than $Vel._m.L$. (where $Vel._m$ is the image member velocity in inches/sec and L is the development zone length along the operative path in inches). It is preferred that the shell velocity be equal to or greater than 3 times $Vel._m.L$. Useful shell rotation can be in either direction but it is preferred to have the shell portions pass through the development zone in a direction co-current with the image member's movement.

As described in the Fritz et al application, it highly desirable that the developer pass through the developer zone co-currently with the image member and that the developer's linear velocity through the development zone be generally equal to (i.e. within about ±15% of) the image member linear velocity. This matching of the developer velocity and photoconductor velocity provides highly useful results for many images. However, a more preferred developer transport rate is one that matches the developer linear velocity to the photoconductor linear velocity within the range of about ±7% of the photoconductor linear velocity. This preferred rate is highly desirable for obtaining good development of fine-line and half-tone dot patterns in images. Slower developer rates lead to development defects of some leading image edges and faster rates lead to development defects of some trailing image edges. Most preferably the photoconductor and developer velocities are substantially equal so as to provide excellent development of leading and trailing edges, fine-line portions and half-tone dot patterns. In embodiments where it is desired for the shell to rotate counter-current to the photoconductor direction, it is highly preferred that the core rotation be sufficient to make the developer transport rate and direction in accord with the foregoing.

The Fritz et al application also points out that it is highly desirable (from the viewpoint of attaining preferred minimum development levels with developers of the types described above) to have the magnetic core and its rotating means cooperate to subject each portion of a photoconductor passing through the development zone to at least 5 pole transitions within the active development nip (i.e. distance L in FIG. 1). One skilled in the art will appreciate that given a nominal photoconductor member velocity $Vel._m$ and development zone length L, specific core constructions and core rotation rates can be selected to comply with this preferred feature in accord with the relation:

$$(P_t \cdot L)/(Vel._m) = Pd \geqq 5$$

where $P_t$ is the number of pole transitions per sec (number of core poles x core revolutions per sec) and Pd is the number of pole transitions to which each image member portion, moving at velocity $Vel._m$, is subjected within the active development region of the length L. This pole transition rate provides adequate tumbling of the carrier in the development zone to efficiently utilize the attracted toner. In this regard, it is highly preferred that the magnetic core comprise a plurality of closely spaced magnets located around the periphery and that the number of magnets be sufficient to subject photoconductor portions to this desired >5 pole transitions within the development nip without extremely high core rotation rates. Cores with from 8 to 24 magnetic poles have been found highly useful.

Based on this desirable minimum pole transition rate and the shell diameter, desirable minimum magnet-effected transport rates can be calculated in terms of a linear velocity (or a similar developer transport rate measured experimentally, e.g. with high speed photography, with a stationary shell and the core rotating at the minimum pole transition rate).

With the maximum cumulative developer transport rate CDT rate (max.) determined to maintain it generally equal to the photoconductor velocity (as described previously) and the minimum magnet-effected developer transport rate MDT rate (min.) selected in accord with the preceeding discussion, the maximum desirable shell-effected developer transport rate SDT rate (max.), and thus the maximum desirable shell rotation rate, can be determined by the relation:

$$\text{SDT rate (max.)} = \text{CDT rate (max.)} - \text{MDT rate (min.)}$$

It will be seen from the foregoing discussions that there are various combinations of shell and core rotations which will result in useful and preferred operating conditions, i.e.: (1) with the developer moving in the proper relative velocity condition to the image member, (2) with the shell moving sufficiently rapidly to avoid adverse image affects and (3) with the core constructed and rotating to provide the desired minimum pole transition exposure to developer moving through the development zone. The present invention provides for cooperatively varying the core and shell rotation rates in a manner which maintains operating conditions within the useful or preferred ranges described above, and which provides the capability of adjusting image development, e.g. image density and/or contrast.

Thus, referring to FIG. 1, the development control system 100 provides for the cooperative adjustment of the nominal rotational rates of the core means 19 and the shell 21, in a manner which maintains proper developer movement relative to the image member. Such adjustments are preferably effected within ranges which maintain minimum desirable shell speed and minimum desirable pole transition requirements.

FIG. 2 illustrates one specific preferred structural embodiment for such a development control system, but one skilled in the art will appreciate that many variations can be devised. The embodiment comprises a logic and control 101, such as a microprocessor, which receives input signals from a development adjustment selector 102 (e.g. an operator key board or a service-personaccessible panel). In response to selected development adjustment selections the unit 101 outputs predetermined digital control signals to digital-to-analog converters 103 and 104 which respectively provide cooperative analog control signals to velocity controls 105 and 106. The velocity controls thus cooperatively adjust the rotational drives 23 (for the shell 21) and 24 (for the core) in accordance with the program adjustment signals output from unit 101 in response to its development adjustment selection signal.

Figure 4:
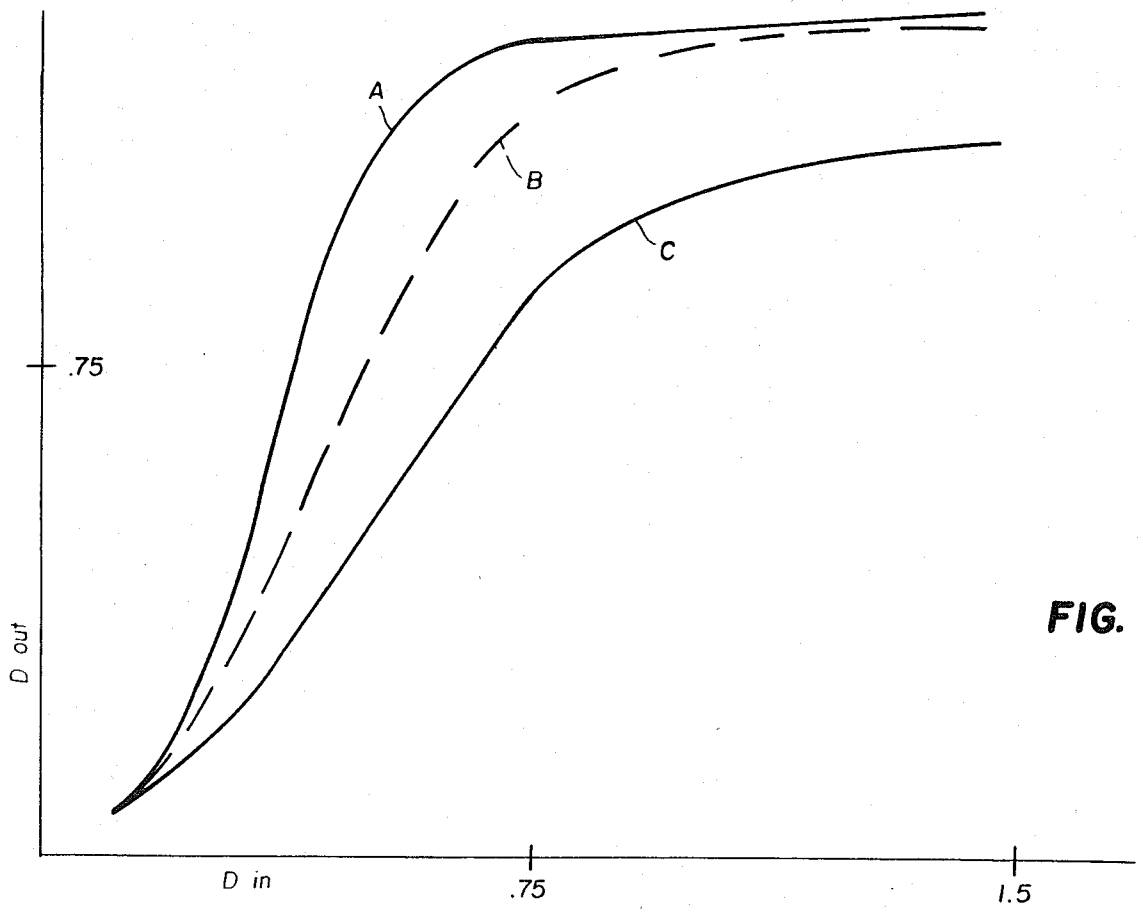
FIG. 4 is a graph illustrating exemplary development adjustments which can be obtained in accordance with the present invention.

FIG. 4 illustrates examples of the different $D_{in}/D_{out}$ curves (i.e. densities of input document image portions, $D_{in}$, plotted against developed densities $D_{out}$ of corresponding output image portions) which can be achieved by such cooperative variation of the core and shell rotations within their desirable or preferred operative ranges. In these examples the image member 18 had a linear velocity of about 11 inches per second, the core diameter of about 1.775 inches and 12 magnetic poles and the shell had a 2 inch outer diameter. The development zone was about 0.25 inches in length (along the operative path) and the shell-to-image spacing was about 0.020 inches.

Curve A illustrates the $D_{in}/D_{out}$ development curve when the shell was rotated at about 14 RPM (in a direction co-current to the image member) and the core was rotated at about 2000 RPM in the opposite direction. This resulted in a developer linear velocity of about 11 inches per second (in a direction co-current with the image member movement).

Curve B illustrates the $D_{in}/D_{out}$ development curve when the core rotation was reduced to 1000 RPM and the shell increased to 52 RPM (with the same rotative directions as described regarding curve A). Again the developer velocity was about 11 inches per second in a direction co-current to the image member.

Curve C illustrates a similar $D_{in}/D_{out}$ development curve when the core rotation was further decreased to 500 RPM and the shell further increased to 70 RPM, again resulting in a developer velocity of 11 inches per second in the co-current direction.

The decrease of $D_{max}$ of curve C is attributable to the fact that its pole transition rate falls below the preferred guideline described above (i.e. the core rotation rate of 500 RPM yielded only 100 transitions per second where the curves A and B respectively had 400 and 200 pole transitions per second).

One skilled in the art will appreciate that by cooperatively varying the shell and core rates to achieve shifts such as from curve A to curve B, highly useful enhancements can be obtained in developed images. Also, such adjustments are useful to adjust the apparatus development characteristic to compensate for developer composition variations, changes in ambient operating conditions or shifts in other electrographic parameters within the apparatus.

The invention has been described in detail with particular reference to preferred embodiments thereof, but it will be understood that variations and modifications can be effected within the spirit and scope of the invention.

What is claimed is:

1. In electrographic apparatus of the type wherein an imaging member bearing an electrostatic image pattern to be developed is moved at a predetermined linear velocity through a development zone whereat developer is applied and which has a development system including:

(a) a supply of dry developer mixture including electrically insulative toner marking particles and hard magnetic carrier particles, both of average particle size less than about 100μ;

(b) a non-magnetic cylindrical shell that is rotatable on an axis for transporting said developer mixture between said supply and said development zone;

(c) a magnetic core that includes a plurality of magnetic pole portions arranged around the core periphery in alternating magnetic polarity relation and is rotatable on an axis within said shell; and (d) means for rotating said shell and said core so that developer is transported through said development zone in a direction co-current with the imaging member direction and at an operative linear velocity that is generally equal to said imaging member's linear velocity, the improvement comprising:

(e) development adjustment means for varying the rotational rate of said shell and said core cooperatively to adjust developed image density and/or contrast while maintaining said operative developer velocity and direction.

2. The invention defined in claim 1 wherein development adjustment means controls said rotating means so that the linear velocity of developer movement through said development zone is in the range from about 93% to about 107% of the linear velocity of said image member at different cooperative shell/core rotation rate selections.

3. The invention defined in claim 1 wherein development adjustment means controls said rotating means so that the linear velocity of developer movement through said development zone is substantially equal to the linear velocity of said image member at different cooperative shell/core rotation rate selections.

4. In electrographic apparatus of the type including (a) means for moving an image member bearing an electrostatic charge pattern through a development zone at a predetermined linear velocity and (b) magnetic brush means which is adapted to supply developer comprised of hard magnetic carrier particles and electrically insulating toner particles and includes (i) a non-magnetic cylindrical shell which is rotatable on an axis for transporting developer between the supply and development zone, (ii) a magnetic core rotatable within said shell and including a plurality of magnetic pole portions arranged around the core periphery in alternating magnetic polarity relation; and (iii) means for rotating said core and said shell so that: (1) successive shell portions pass through said development zone at a rate which prevents toner plateout on said shell from adversely affecting image development and (2) the linear velocity of developer movement through said development zone is co-current with and generally equal to the linear velocity of said image member, the improvement comprising development adjustment means for varying the rotation of said shell and said core cooperatively to adjust developed image density and/or contrast while maintaining said operative developer velocity and direction.

5. The invention defined in claim 4 wherein said development adjustment means controls said rotating means so that the linear velocity of developer movement through said development zone differs from the linear velocity of said image member by no more than ±7% of said image member velocity.

6. The invention defined in claim 4 wherein said development adjustment means controls said rotating means so that the linear velocity of developer movement through said development zone is substantially equal to the linear velocity of said image member.

7. A method of developing an electrographic image member bearing an electrostatic image pattern, said method comprising:

(a) moving said image member through a development zone at a predetermined linear velocity; and (b) transporting electrographic developer, including hard magnetic carrier particles and electrically insulative toner particles, through said development zone in developing relation with the charge pattern of such moving imaging member, by:

(1) rotating a non-magnetic shell around a path, between a supply of such developer and said development zone;

(2) rotating an alternating-pole magnetic core within said shell;

(3) controlling the directions and speeds of said shell and core rotations so that developer flows through said development zone in a direction co-current with the direction of image member movement and at an operative linear velocity that is generally equal to the linear velocity of said image member; and (4) varying said shell and core speeds cooperatively to adjust developed image density and/or contrast while maintaining said operative developer velocity and direction.

8. The invention defined in claim 7 wherein said shell and core are cooperatively rotated, at each rate variation, so that developer flows through said development zone at a linear velocity substantially equal to the linear velocity of said image member.

9. The invention defined in claim 7 wherein the shell and core are cooperatively rotated, at each rate variation, so that developer flows through the development zone co-currently with said imaging member with a linear velocity which differs from said imaging member by no more than ±7% of the imaging member velocity.

* * * * *